United States Patent [19]

Gibson et al.

[11] 4,080,933

[45] Mar. 28, 1978

[54] HEATED ENCLOSURES

[75] Inventors: Thomas Gibson, Barnet; Roger W. Hillis, Woking, both of England

[73] Assignee: Foster Wheeler Energy Corporation, Livingston, N.J.

[21] Appl. No.: 727,905

[22] Filed: Sep. 30, 1976

[30] Foreign Application Priority Data

Sep. 19, 1975 United Kingdom ..... 38596/75

[51] Int. Cl.[2] ..... F22B 21/34

[52] U.S. Cl. ..... 122/336; 122/478

[58] Field of Search ..... 122/235 R, 235 A, 235 C, 122/235 K, 332, 333, 336, 347, 478

[56] References Cited

U.S. PATENT DOCUMENTS

| | | | |
|---|---|---|---|
| 2,763,243 | 9/1956 | Marshall | 122/347 |
| 2,825,312 | 3/1958 | Kolling | 122/333 |
| 3,003,482 | 10/1961 | Hamilton et al. | 122/478 |

FOREIGN PATENT DOCUMENTS

| | | | |
|---|---|---|---|
| 1,136,849 | 1/1957 | France | 122/235 |

*Primary Examiner*—Kenneth W. Sprague

*Attorney, Agent, or Firm*—Marvin A. Naigur; John E. Wilson

[57] ABSTRACT

Disclosed herein is a marine steam boiler. It includes a furnace, and a convection section including a bank of steam generating tubes. The walls, roof and floor of the boiler are made into an air tight enclosure by being formed from finned water tubes adjacent ones of which are joined to one another by fins. The spacings of the adjacent tubes in the walls, floor and roof are all substantially identical. The water tubes forming these walls extend directly from a lower water drum through the walls to an upper steam water drum and so there is no difficulty of reduced circulation due to intervening headers. Also because the walls, roof and floor are air tight only a thin cover of refractory is required and this reduces problems of cracking when the boiler is used in a motor ship where it would be subject to considerable vibrations.

2 Claims, 3 Drawing Figures

HEATED ENCLOSURES

This invention relates to improvements in boilers or furnaces and relates particularly, but no exclusively, to marine boilers for auxiliary steam services.

BACKGROUND TO THE INVENTION

In motor propelled ships it is customary to provide a boiler to supply steam for auxiliary services such as cargo-handling winches and other small steam driven machinery. In most designs of boiler furnaces, a considerable amount of refractory is necessary, and in motor ships this refractory is prone to vibration damage. This damage can be avoided by providing a furnace whose walls, roof and floor are constructed from longitudinally finned tubes welded together to form a gas tight furnace. Such a design, however, involves the use of headers and high drum-centers to ensure adequate circulation under list and rolling conditions. These headers are very expensive and restrict circulation, thus reducing safety margins.

To allow for heat losses and to ensure dry steam at the consumer position, a small degree of superheat is normally provided. But to avoid the penetration of walls in high gas temperature zones and the subsequent complex sealing arrangements, it is necessary to position the superheater outside the boiler and this necessitates having a low-velocity gas flow across the generating tubes with a consequent drop in heat exchange efficiency. Therefore to ensure efficient use of the superheating surface area, it is necessary to accept reduced efficiency of the boiler.

The invention has therefore been made with these points in mind.

BRIEF SUMMARY OF THE INVENTION

According to the invention there is provided a marine steam boiler comprising a furnace enclosure leading to a bank of steam generating tubes across which hot combustion gases flow from the furnace, the furnace enclosure having front and side walls, a floor and a roof all formed by walls of finned water tubes, adjacent tubes in the walls, floor and roof being joined to one another by fins to define an air-tight enclosure and the spacing of adjacent tubes in the walls, floor and roof being substantially identical, the water tubes forming the front wall extending directly from a lower water drum across the floor to form at least part of the latter, up the front wall, and across the roof to form at least part of the latter to an upper steam drum, and the water tubes forming the side walls extending, if required to complete the floor or roof, across the floor or roof, respectively to the side walls from the lower or upper drum respectively, or if not so required from the lower or upper drum to the side wall in one or more planes parallel to the floor or roof, respectively, the tubes of the bank of steam generating tubes extending directly between the upper and lower drums and the outermost tubes of the bank being joined by fins to give an air-tight rear wall for the boiler and complete, together with the side walls of the furnace, air-tight side walls for the boiler.

With such a marine steam boiler according to the invention the use of headers is thus eliminated and one can achieve adequate circulation because the tubes extend directly between the drums. In addition because the whole boiler is gas tight one can greatly reduce the amount of refractory required.

The burners for the furnace can be positioned at choice in the floor, roof, side walls, front wall, or rear wall without modification of the basic layout of the boiler. Also the bank of steam generating tubes and any superheater tubes required can then be positioned to provide for optimum heat exchange efficiency. The bank of steam generating tubes can be shielded from the furnace by a tube panel of water tubes and so the bank of tubes forms a convection section of the boiler. The superheating tubes can then be positioned in that convection section possibly in place of some of the steam generating tubes. Because the gas temperature in that convection section will be relatively low, there will then be no difficulty in sealing the region where these superheating tubes or their headers penetrate the boiler wall.

In one preferred embodiment of the invention the side walls of the furnace form an angle of about 109½° to the front wall of the furnace. One third of the tubes forming the side walls constitute part of the floor or roof of the furnace in their passage to the side walls from the drums. The remaining two thirds of the tubes extend to the side walls from the lower or upper drums in one or more planes parallel to and adjacent to the floor or roof respectively.

BRIEF DESCRIPTION OF THE DRAWINGS

The invention will be further described by way of example and with reference to the accompanying drawings, in which.

DESCRIPTION OF THE PREFERRED EMBODIMENTS

Figure 1:
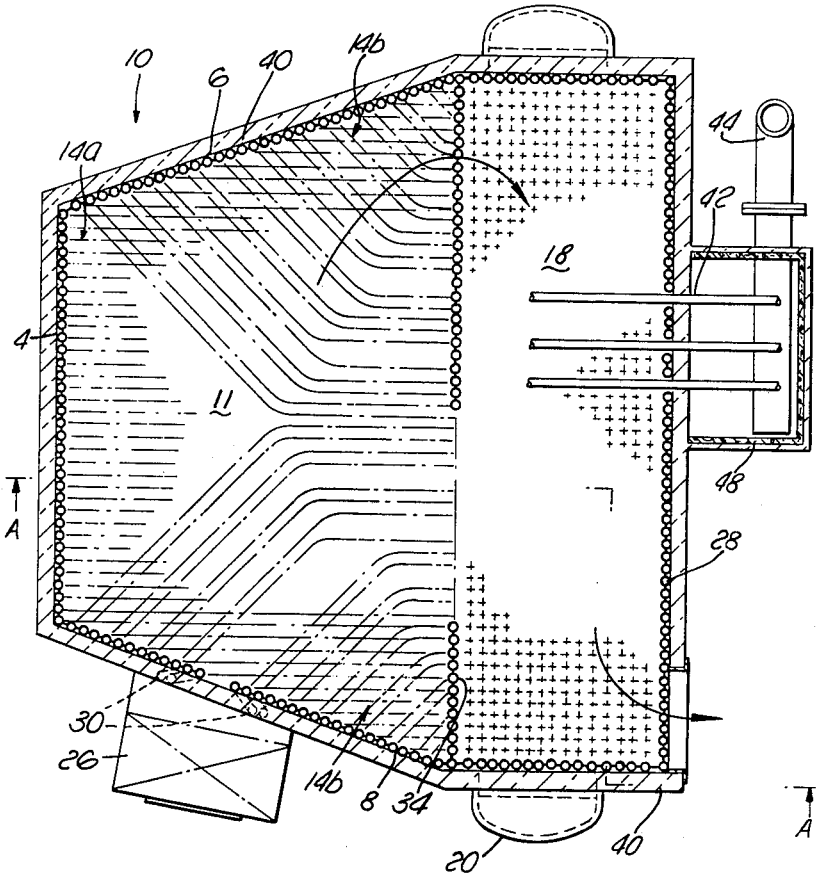
FIG. 1 is a sectional plan view of a boiler according to the invention.
Figure 2:
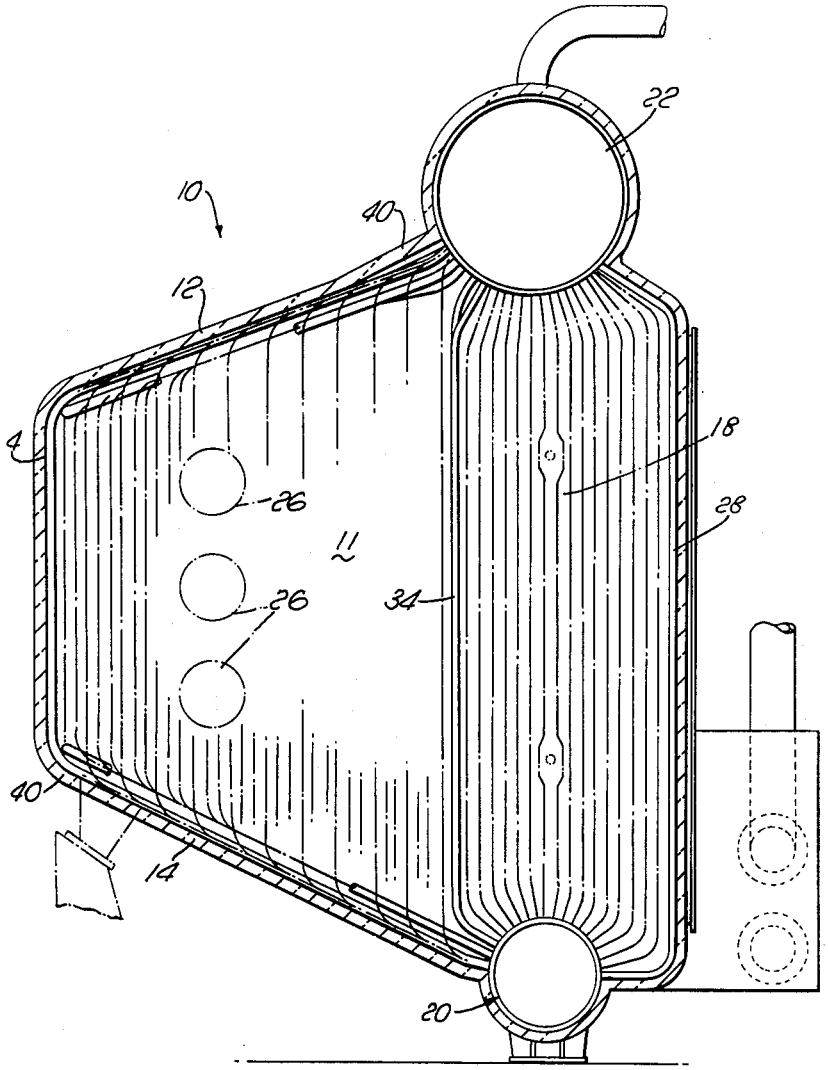
FIG. 2 is a section taken along the line A—A of FIG. 1.
Figure 3:
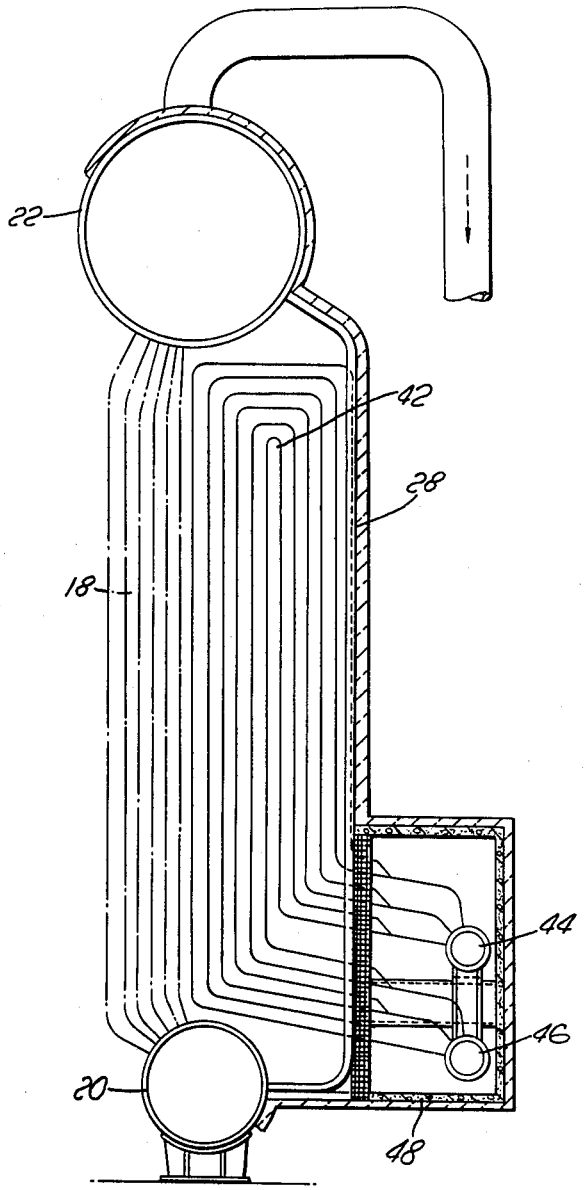
FIG. 3 is a section through a superheater which can be used with the boiler of FIGS. 1 and 2.

The marine steam boiler 10 shown in FIGS. 1 and 2 comprises a furnace 11 defined by a roof 12, floor 14, side walls 6 and 8, and a front wall 4. At the rear of the furnace 11 in a bank 18 of steam generating tubes is provided. These tubes extend directly between a lower steam and water drum 20 and an upper steam and water drum 22. In the side wall 8 of the furnace 11 are provided an upright row of burners 26.

The walls, roof and floor of the furnace 11 are formed by walls or panels of water tubes. Adjacent tubes in these panels are joined to one another by fins so as to make the panels gas-tight. The spacing of all of the tubes of the panels forming the walls, roof and floor of the furnace are identical.

As can be seen from the drawings the side walls form an angle of 109½° with the front wall 4 and in addition the roof 12 and floor 14 are inclined so that the overall height of the furnace increases in the direction from the front wall 4 to the bank 18 of tubes. The roof 12 and floor 14 can, therefore, be considered as each consisting of three portions, a central rectangular portion **12*a* or 14*a*, respectively, flanked on either side by triangular portions 12*b* and 14*b***, respectively.

The panels defining the walls, roof and floor of the furnace 11 are made up of tubes which are joined at their extremeties directly to the lower and upper drums 20 and 22. The central portions **12*a* and 14*a* of the roof and floor, respectively, and the front wall 4 are composed of tubes which run parallel to one another from the lower steam and water drum 20 across the central portion 14***a* of the floor up the front wall 4 and across the central portion 12*a* of the roof to the upper steam and water drum 22. The tubes forming the side walls 6 and 8 follow one or other of two paths. One third of the tubes extend across the triangular portions 12*b* or 14*b*, respectively, of the roof or floor to complete the latter. Where these tubes are positioned in the roof or floor they run parallel to the tubes of the portions 12*a* or 14*a*. Where these tubes abut the side walls 6 or 8 they are bent upwardly or downwardly as the case may be into line with the side walls. The other two thirds of the tubes are positioned so as to extend within the side walls so that there are a pair of such tubes between each of the tubes constituting the portions 12*b* and 14*b*. These remaining two thirds of the tubes extend directly from the lower water drum 20 across the floor 14 to their respective side walls. Where they cross the floor they run parallel to the floor and are adjacent to the floor. In a similar fashion these tubes leave the top of the side wall and extend parallel to the roof 12 but adjacent to it across the roof to the upper steam and water drum 22.

In the side wall 8 some of the tubes in the tube panel are locally bent apart as shown for the tubes 30 to provide ports for the burners.

The outermost tubes of the bank of tubes 18 are joined to one another by fins so as to complete a gas tight boiler and provide a rear wall 28 to the boiler and complete, with the furnace side walls 6 and 8, side walls for the boiler. Additionally the row 34 of tubes in the bank 18 nearest the burners are joined to one another by fins to provide a baffle extending the majority of the way across the boiler. In this way the baffle directs the combustion gases formed in the furnace to take a path across the furnace and through a convection inlet to the bank 18 of tubes, this inlet being formed in the row 34 in the region of the side wall 6 by omitting the fins of the tubes in the row 34. An outlet flue for the gases from the boiler is provided by locally omitting some of the fins on the tubes constituting the rear wall 28 at the end of the bank 18 adjacent the side wall 8.

Because the furnace 11 and indeed the whole of the boiler 10 is surrounded by gas-tight water tube panels it needs only a relatively thin surrounding refractory coating 40. This is important in marine boilers since it reduces the chances of cracking which can occur when thick refractory coatings are required and the boiler is subjected to vibration.

A superheater may or may not be required with the steam boiler 10. If it is required it can be provided in the form of loops of tubes 42 extending into the bank of steam generating tubes 18 in place of some of the latter tubes. These loops of superheating tubes extend from an inlet header 44 to an outlet header 46 positioned outside the rear wall 28 and the fins on the tubes constituting the rear wall 28 are locally cut away to allow the loops of tubes to pass through the wall. Of course, the region of penetration of the superheater tubes through the rear wall 28 is not a high gas temperature zone as would be the furnace 11. A complex sealing arrangement around the superheater inlet and outlet headers is not necessary. Instead a simple sealed enclosure 48 covered with refractory is sufficient.

A latitude of modification, change and substitution is intended in the foregoing disclosure and in some instances some features of the invention will be employed with a corresponding use of other features. Accordingly it is appropriate that the appended claims be construed broadly and in a manner consistent with the spirit and scope of the invention.

What is claimed is:

1. A marine boiler comprising a. a furnace section including front and side walls, roof and floor, said walls, roof and floor including rigidly united fluid cooled tubes, said front wall tubes extending from their upper ends to form a central section of said roof and extending from their lower ends to form a central section of said floor, some of said side wall tubes extending from their upper ends to form end sections of said roof and extending from their lower ends to form end sections of said floor, the remaining side wall tubes extending from their upper ends below and parallel to said roof tubes and extending from their lower ends above and parallel to said floor tubes, b. a steam and water drum adjacent said roof, said roof tubes and said tubes extending below and parallel to said roof tubes being connected to said steam and water drum, c. a water drum adjacent said floor, said floor tubes and said tubes extending above and parallel to said floor tubes being connected to said water drum, d. a convection section adjacent said furnace section and including a plurality of rigidly united fluid cooled tubes extending between said water drum and said steam and water drum, said convection section together with said furnace section, water drum and steam and water drum defining a gas-tight enclosure, e. a burner disposed in one of said side walls of said furnace section, and f. a plurality of vapor generating tubes disposed within said enclosure and extending between said water drum and said steam and water drum, some of said tubes closest to said burner being rigidly united and defining a baffle extending part of the way across said furnace section.

2. The marine boiler of claim 1 further comprising a superheater disposed in said convection section, and means for passing steam from said steam and water drum to said superheater, said superheater being disposed adjacent the rear of said convection section in a low gas temperature region of said convection section.

* * * * *